US009595224B2

(12) United States Patent
Toyomura et al.

(10) Patent No.: US 9,595,224 B2
(45) Date of Patent: Mar. 14, 2017

(54) DISPLAY DEVICE, METHOD OF DRIVING DISPLAY DEVICE AND ELECTRONIC APPARATUS

(71) Applicant: JOLED INC., Tokyo (JP)

(72) Inventors: Naobumi Toyomura, Kanagawa (JP); Hitoshi Kawada, Tokyo (JP)

(73) Assignee: JOLED Inc., Tokyo (JP)

( * ) Notice: Subject to any disclaimer, the term of this patent is extended or adjusted under 35 U.S.C. 154(b) by 93 days.

(21) Appl. No.: 14/511,580

(22) Filed: Oct. 10, 2014

(65) Prior Publication Data

US 2015/0109280 A1 Apr. 23, 2015

(30) Foreign Application Priority Data

Oct. 17, 2013 (JP) ..... 2013-215957

(51) Int. Cl.
*G09G 3/32* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2320/043* (2013.01)

(58) Field of Classification Search
None
See application file for complete search history.

(56) References Cited

U.S. PATENT DOCUMENTS

2006/0061560 A1* 3/2006 Yamashita ..... G09G 3/3233 345/204
2006/0170628 A1* 8/2006 Yamashita ..... G09G 3/3233 345/76
2008/0049053 A1* 2/2008 Asano ..... G09G 3/3233 345/697
2010/0033477 A1* 2/2010 Yamashita ..... G09G 3/3233 345/215
2010/0253707 A1* 10/2010 Miyake ..... G09G 3/3233 345/690
2011/0013099 A1* 1/2011 Sugimoto ..... G09G 3/3233 348/800
2014/0035797 A1* 2/2014 Jinta ..... G09G 3/30 345/77
2014/0035890 A1* 2/2014 Jinta ..... G09G 3/20 345/204
2014/0285542 A1* 9/2014 Izumi ..... G09G 3/2003 345/694

FOREIGN PATENT DOCUMENTS

JP 2008-225345 9/2008

* cited by examiner

*Primary Examiner* — David D Davis
(74) *Attorney, Agent, or Firm* — Michael Best & Friedrich LLP

(57) ABSTRACT

A display device includes a pixel array unit in which pixels are arranged, each pixel including a light emitting unit, a writing transistor that writes a video signal, a driving transistor that drives the light emitting unit based on the video signal written by the writing transistor, and a switching transistor that applies a fixed potential to one terminal of the light emitting unit, and a driving unit that causes the light emitting unit to enter a light extinction state by writing a voltage causing the driving transistor to enter a non-conduction state to a gate electrode of the driving transistor.

11 Claims, 9 Drawing Sheets

$$G_{bst} = \frac{\Delta V_g}{\Delta V_s} = \frac{C_s + C_{gs}}{C_s + C_{ws} + C_{gd} + C_{gs}} \cdots (1)$$

$$G_{in} = \frac{\Delta V_s}{\Delta V_g} = \frac{C_s + C_{gs}}{C_s + C_{gs} + C_{oled}} \quad \cdots (2)$$

DISPLAY DEVICE, METHOD OF DRIVING DISPLAY DEVICE AND ELECTRONIC APPARATUS

CROSS REFERENCE TO RELATED APPLICATIONS

This application claims the benefit of Japanese Priority Patent Application JP 2013-215957 filed Oct. 17, 2013, the entire contents of which are incorporated herein by reference.

BACKGROUND

This disclosure relates to a display device, a method of driving the display device, and an electronic apparatus.

In recent years, a flat (flat panel type) display device in which pixels each including a light emitting unit are arranged in a matrix form has become mainstream as a display device. In this type of display device, a driving circuit for driving the light emitting unit may include a driving circuit having a configuration having three transistors (Tr) of a writing transistor that writes a video signal, a driving transistor that drives the light emitting unit, and a switching transistor that applies a fixed potential to a source electrode of the driving transistor (for example, see Japanese Unexamined Patent Application Publication No. 2008-225345).

SUMMARY

In the display device including the driving circuit having the configuration described above, when the switching transistor enters a conduction state, and a fixed potential is applied to the source electrode of the driving transistor, a light extinction period of the light emitting unit starts. However, in the light extinction period of the light emitting unit, since a period of time in which the driving transistor and the switching transistor are in a conduction state together increases, a lot of through current flows from the driving transistor via the switching transistor. As a result, a lot of unutilized power that does not contribute to the emission of the light emitting unit is consumed.

Therefore, it is desirable to provide a display device, a method of driving the display device, and an electronic apparatus having the display device in which a through current flowing from a driving transistor via a switching transistor can be suppressed during a light extinction period of a light emitting unit.

According to an embodiment of the present disclosure, there is provided a display device including a pixel array unit in which pixels are arranged, each pixel including a light emitting unit, a writing transistor that writes a video signal, a driving transistor that drives the light emitting unit based on the video signal written by the writing transistor, and a switching transistor that applies a fixed potential to one terminal of the light emitting unit; and a driving unit that causes the light emitting unit to enter a light extinction state by writing a voltage causing the driving transistor to enter a non-conduction state to a gate electrode of the driving transistor.

Further, according to another embodiment of the present disclosure, there is provided a method of driving a display device in which pixels are arranged, each pixel including a light emitting unit, a writing transistor that writes a video signal, a driving transistor that drives the light emitting unit based on the video signal written by the writing transistor, and a switching transistor that applies a fixed potential to one terminal of the light emitting unit, in which a voltage causing the driving transistor to enter a non-conduction state is written to a gate electrode of the driving transistor to cause the light emitting unit to enter a light extinction state in driving the display device.

Further, according to still another embodiment of the present disclosure, there is provided an electronic apparatus with a display device including a pixel array unit in which pixels are arranged, each pixel including a light emitting unit, a writing transistor that writes a video signal, a driving transistor that drives the light emitting unit based on the video signal written by the writing transistor, and a switching transistor that applies a fixed potential to one terminal of the light emitting unit; and a driving unit that causes the light emitting unit to enter a light extinction state by writing a voltage causing the driving transistor to enter a non-conduction state to a gate electrode of the driving transistor.

In the display device, the method of driving the display device, or the electronic apparatus that has the configuration described above, the voltage causing the driving transistor to enter a non-conduction state is written to the gate electrode of the driving transistor. Accordingly, the driving transistor enters a non-conduction state, an emission period of the light emitting unit ends, and a light extinction period starts. In other words, the timing of the start of the light extinction period is defined as a timing at which the writing transistor enters a conduction state, not a timing at which the switching transistor enters a conduction state. Also, as the driving transistor enters the non-conduction state, it is possible to suppress a through current flowing from the driving transistor via the switching transistor.

According to the embodiments of the present disclosure, in the light extinction period of the light emitting unit, since the through current flowing from the driving transistor via the switching transistor can be suppressed, it is possible to suppress consumption of unutilized power that does not contribute to the emission of the light emitting unit.

In addition, the present disclosure is not necessarily limited to the effects described herein, and any effect described in the present specification may be obtained. In addition, the effects described in the present specification are only illustrative, the present disclosure is not limited thereto, and there may be additional effects.

DETAILED DESCRIPTION OF EMBODIMENTS

Figure 1:
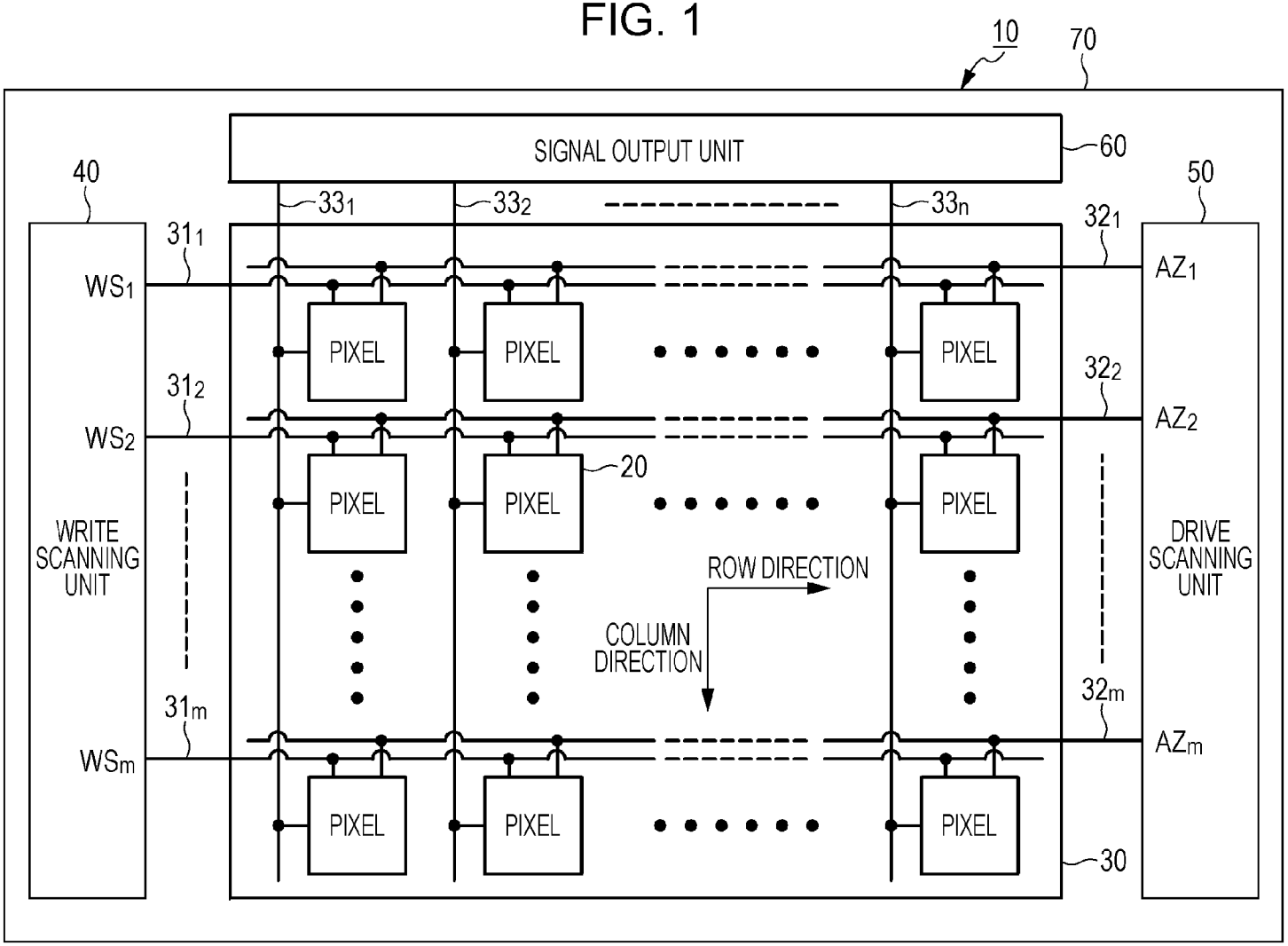
FIG. 1 is a system configuration diagram illustrating a schematic basic configuration of an active matrix display device to which a technology of the present disclosure is applied.

Hereinafter, forms of carrying out a technology of the present disclosure (hereinafter referred to as "embodiments") will be described in detail using the drawings. The technology of the present disclosure is not limited to the embodiments, and various numerical values or the like in the embodiments are illustrative. In the following description, the same elements, or elements having the same function will be denoted with the same reference signs and repeated description will be omitted. In addition, description will be given in the following order.

1. Entire description of a display device, a method of driving the display device, and an electronic apparatus of the present disclosure
2. Display device to which a technology of the present disclosure is applied
   2-1. System configuration
   2-2. Pixel circuit
   2-3. Driving method according to a comparative example
3. Description of embodiments
   3-1. Embodiment 1
   3-2. Embodiment 2
   3-3. Embodiment 3
4. Modification example
5. Electronic apparatus Entire description of a display device, a method of driving the display device, and an electronic apparatus of the present disclosure The display device of the present disclosure is a flat (flat panel type) display device in which pixels (pixel circuits) are arranged, each having a configuration in which a driving circuit for driving a light emitting unit includes at least three transistors (Tr) of a writing transistor, a driving transistor, and a switching transistor. Examples of the flat display device may include an organic EL display device, a liquid crystal display device, and a plasma display device. In the organic EL display device among these display devices, electro luminescence (EL) of an organic material is used, and an organic EL element using a phenomenon in which light is emitted when an electric field is applied to an organic thin film is used as a light emitting element (electro-optic element) of the pixel.

The organic EL display device in which the organic EL element is used as a light emitting unit of the pixel has the following features. That is, the organic EL display device has low power consumption since the organic EL element can be driven with applied voltages equal to or lower than 10 V. The organic EL display device has higher image visibility than the liquid crystal display device that is the same flat display device since the organic EL element is a self light emitting element, and is easily made lightweight and thin since an illumination member such as a backlight is not necessary. Further, in the organic EL display device, no afterimage is generated at the time of video display since a response speed of the organic EL element is as very high as about several microseconds.

The organic EL element constituting the light emitting unit is a self light emitting element and is a current-driven electro-optic element whose emission luminance changes according to the value of a current flowing in a device. Examples of the current-driven electro-optic element may include an inorganic EL element, an LED element, and a semiconductor laser element, as well as the organic EL element.

The flat display device, such as the organic EL display device, can be used as a display unit (display device) in various electronic apparatuses with a display unit. Examples of various electronic apparatuses may include a digital camera, a video camera, a game console, a laptop type personal computer, a portable information device such as an electronic book, a personal digital assistant (PDA), or a mobile communication device such as a portable phone.

In the display device, the method of driving the display device, and the electronic apparatus of the present disclosure, each pixel of a pixel array unit can have a configuration having a function of performing correction of a variation in driving current caused by a variation in threshold voltage of a driving transistor (hereinafter referred to also as "threshold correction"). In this case, a voltage causing the driving transistor to enter a non-conduction state can be used as a reference voltage that is used when the threshold correction is performed. In addition, a driving unit can have a configuration for writing the voltage causing the driving transistor to enter a non-conduction state to a holding capacitor.

In the display device, the method of driving the display device and the electronic apparatus of the present disclosure including the preferred configuration described above, the driving unit can have a configuration in which a fixed potential is applied to a source of the driving transistor via the switching transistor in a state in which the voltage causing the driving transistor to enter a non-conduction state is written to a gate of the driving transistor. In this case, the driving unit can have a configuration in which, when the switching transistor is in a conduction state, a voltage lower than the voltage causing the driving transistor to enter a non-conduction state is written to the gate of the driving transistor.

In addition, in the display device, the method of driving the display device, and the electronic apparatus of the present disclosure including the preferred configuration described above, the threshold voltage of the driving transistor is $V_{th_Drv}$, and the fixed potential applied to the source of the driving transistor is $V_{ss}$. In this case, the voltage written to the gate of the driving transistor can be a voltage lower than ($V_{th_Drv}+V_{ss}$) in a conduction state of the switching transistor.

In addition, in the display device, the method of driving the display device, and the electronic apparatus of the present disclosure including the preferred configuration described above, the voltage written to the gate of the driving transistor in the conduction state of the switching transistor can be a voltage lower than a reference voltage that is used when the threshold voltage is corrected. In addition, the driving unit can have a configuration in which the reference voltage that is used when the threshold voltage is corrected and the voltage lower than the reference voltage are written to the gate of the driving transistor via the writing transistor.

In addition, in the display device, the method of driving the display device, and the electronic apparatus of the present disclosure including the preferred configuration described above, the threshold voltage of the writing transistor is $V_{th_WS}$, the threshold voltage of the driving transistor is $V_{th_Drv}$ and the fixed potential applied to the source of the driving transistor is $V_{ss}$. Also, the voltage causing the writing transistor to enter a non-conduction state is set to be lower than ($V_{th_WS}+V_{th_Drv}+V_{ss}$). In this case, the driving unit can have a configuration in which a fixed potential is applied to the source of the driving transistor via the switching transistor before the reference voltage that is used when the threshold voltage is corrected is written to the gate of the driving transistor. Display device to which a technology of the present disclosure is applied.

System Configuration

FIG. 1 is a system configuration diagram illustrating a schematic basic configuration of an active matrix display device to which a technology of the present disclosure is applied.

The active matrix display device is a display device in which a current flowing in an electro-optic element is controlled using an active element, such as an insulated gate field effect transistor, provided within the same pixel as a pixel in which the electro-optic element is provided. A thin film transistor (TFT) can be typically used as the insulated gate field effect transistor.

Here, a case of the active matrix organic EL display device in which, for example, an organic EL element that is a current-driven electro-optic element whose emission luminance changes according to the value of a current flowing in a device is used as a light emitting element (light emitting unit) of a pixel (a pixel circuit), will be described by way of example. Hereinafter, the "pixel circuit" may be simply described as a "pixel."

The organic EL display device 10 of the present disclosure includes a pixel array unit 30 in which a plurality of pixels 20 including organic EL elements are arranged two-dimensionally in a matrix form, and a driving unit (a driving circuit unit) arranged around the pixel array unit 30, as illustrated in FIG. 1. The driving unit includes, for example, a write scanning unit 40, a drive scanning unit 50, and a signal output unit 60 that are mounted on the same display panel 70 as that on which the pixel array unit 30 is mounted, and drives each pixel 20 of the pixel array unit 30. In addition, a configuration in which some or all of the write scanning unit 40, the drive scanning unit 50 and the signal output unit 60 are provided outside the display panel 70 can be adopted.

Here, when the organic EL display device 10 is for a color display, one pixel (unit pixel/pixel) that is a unit for forming a color image includes a plurality of sub-pixels. In this case, each of the sub-pixels corresponds to the pixel 20 of FIG. 1. More specifically, in a display device for a color display, one pixel includes, for example, three sub-pixels including a sub-pixel that emits red (R) light, a sub-pixel that emits green (G) light, and a sub-pixel that emits blue (B) light.

However, one pixel is not limited to a combination of sub-pixels of 3 primary colors of RGB, and can include a sub-pixel of one color or a plurality of colors, in addition to the sub-pixels for 3 primary colors. More specifically, for example, a sub-pixel that emits white (W) light for luminance improvement is added to constitute one pixel, or at least one sub-pixel that emits complementary color light to extend a color reproduction range is added to constitute one pixel.

In the pixel array unit 30, for an arrangement of the pixels 20 of m rows and n columns, a scanning line 31 ($\mathbf{31}_1$, to $\mathbf{31}_m$) and a driving line 32 ($\mathbf{32}_1$ to $\mathbf{32}_m$) are wired for each pixel row in a row direction (an arrangement direction of the pixels in a pixel row/a horizontal direction). Further, for the arrangement of the pixels 20 of m rows and n columns, a signal line 33 ($\mathbf{33}_1$ to $\mathbf{33}_n$) is wired for each pixel column in a column direction (an arrangement direction of the pixels in a pixel column/a vertical direction).

The scanning lines $\mathbf{31}_1$ to $\mathbf{31}_m$ are connected to respective output ends of corresponding rows of the write scanning unit 40. The driving lines $\mathbf{32}_1$ to $\mathbf{32}_m$ are connected to respective output ends of corresponding rows of the drive scanning unit 50. The signal lines $\mathbf{33}_1$ to $\mathbf{33}_n$ are connected to respective output ends of corresponding columns of the signal output unit 60.

The write scanning unit 40 includes, for example, a shift register circuit. This write scanning unit 40 performs so-called line sequential scanning to scan the respective pixels 20 of the pixel array unit 30 in units of rows by sequentially supplying a write scanning signal WS ($WS_1$ to $WS_m$) to the scanning line 31 ($\mathbf{31}_1$ to $\mathbf{31}_m$) when writing a signal voltage of a video signal to the respective pixels 20 of the pixel array unit 30.

The drive scanning unit 50 includes, for example, a shift register circuit, similar to the write scanning unit 40. This drive scanning unit 50 supplies a drive scanning signal AZ ($AZ_1$ to $AZ_m$) to the driving line 32 ($\mathbf{32}_1$ to $\mathbf{32}_m$) in synchronization with the line sequential scanning by the write scanning unit 40.

The signal output unit 60 selectively outputs a signal voltage of a video signal according to luminance information to be supplied from a signal supply source (not illustrated) (hereinafter may be described simply as a "signal voltage") $V_{sig}$, and a reference voltage $V_{ofs}$. Here, the reference voltage $V_{ofs}$ is a voltage that is a reference of the signal voltage $V_{sig}$ of the video signal (for example, a voltage corresponding to a black level of the video signal), and is used at the time of a threshold correction process to be described below.

The signal voltage $V_{sig}$/the reference voltage $V_{ofs}$ output from the signal output unit 60 is written to each pixel 20 of the pixel array unit 30 via the signal line 33 ($\mathbf{33}_1$ to $\mathbf{33}_n$) in units of pixel rows selected through the scanning by the write scanning unit 40. In other words, the signal output unit 60 adopts a driving form based on line sequential writing in which the signal voltage $V_{sig}$ is written in units of rows (lines).

Pixel Circuit

Figure 2:
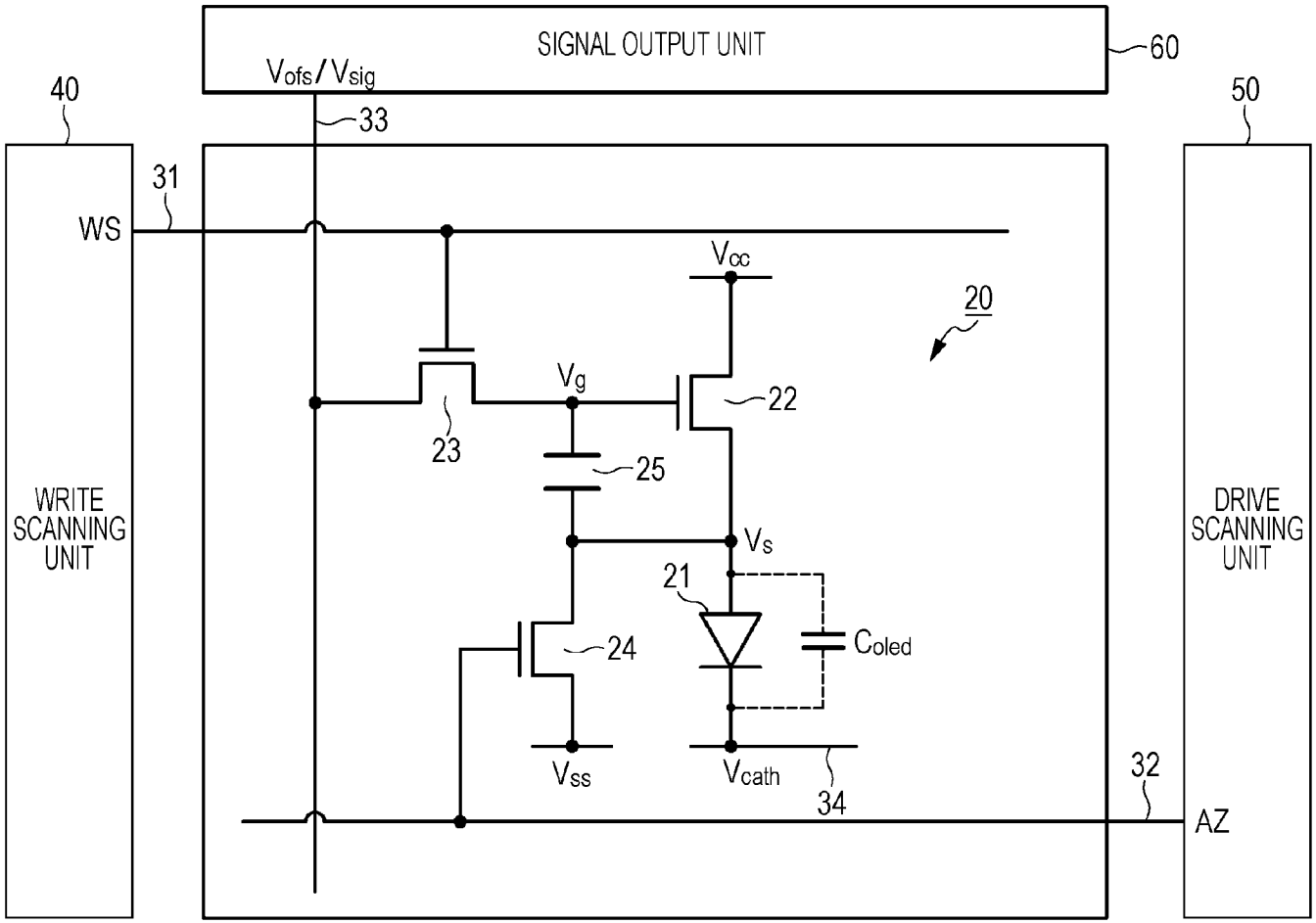
FIG. 2 is a circuit diagram illustrating an example of a specific circuit configuration of a pixel (pixel circuit)

FIG. 2 is a circuit diagram illustrating an example of a specific circuit configuration of the pixel (pixel circuit) 20. A light emitting unit of the pixel 20 includes an organic EL element 21 that is a current-driven electro-optic element whose emission luminance changes according to the value of a current flowing in the device.

The pixel 20 includes the organic EL element 21, and a driving circuit that drives the organic EL element 21 by flowing a current to the organic EL element 21, as illustrated in FIG. 2. The organic EL element 21 includes a cathode electrode connected to a common power supply line 34 wired for all the pixels 20 in common. In addition, an equivalent capacitor $C_{oled}$ of the organic EL element 21 is also illustrated in FIG. 2.

The driving circuit that drives the organic EL element 21 has a 3Tr1C configuration in which at least three transistors (Tr) of a driving transistor 22, a writing transistor 23 and a switching transistor 24, and one holding capacitor (C) 25 are included. N channel transistors can be used as the driving transistor 22, the writing transistor 23 and the switching transistor 24. However, a combination of conductivity types of the driving transistor 22, the writing transistor 23 and the switching transistor 24 illustrated herein is only an example and the present disclosure is not limited to the combination thereof.

In the driving transistor 22, a source electrode is connected to an anode electrode of the organic EL element 21, and a drain electrode is connected to a node for a power supply voltage $V_{cc}$. In the writing transistor 23, one of source and drain electrodes is connected to the signal line 33 ($\mathbf{33}_1$ to $\mathbf{33}_n$), and the other electrode is connected to a gate electrode of the driving transistor 22. In addition, a gate electrode of the writing transistor 23 is connected to the scanning line 31 ($\mathbf{31}_1$ to $\mathbf{31}_m$).

In the switching transistor 24, one of source and drain electrodes is connected to the source electrode of the driving transistor 22 and an anode electrode of the organic EL element 21, and the other electrode is connected to a node for a fixed potential $V_{ss}$. In addition, the gate electrode of the switching transistor 24 is connected to the driving line 32 ($\mathbf{32}_1$ to $\mathbf{32}_m$). In the holding capacitor 25, one electrode is connected to the gate electrode of the driving transistor 22, and the other electrode is connected to the source electrode of the driving transistor 22 and the anode electrode of the organic EL element 21.

Here, when a threshold voltage of the organic EL element 21 is $V_{th_EL}$ and a potential of the common power supply line 34, that is, a cathode potential of the organic EL element 21 is $V_{cath}$, the fixed potential $V_{ss}$ applied to the other electrode of the switching transistor 24 is set to satisfy a relationship of $V_{ss}<V_{cath}+V_{th_EL}$.

In the pixel 20 having the configuration described above, the writing transistor 23 enters a conduction state in response to the write scanning signal WS whose high voltage state becomes an active state, which is applied from the write scanning unit 40 to the gate electrode via the scanning line 31. Accordingly, the writing transistor 23 writes, to the pixel 20, the signal voltage $V_{sig}$ of the video signal according to luminance information or the reference voltage $V_{ofs}$ supplied from the signal output unit 60 via the signal line 33 at a different timing. The signal voltage $V_{sig}$ or the reference voltage $V_{ofs}$ written by the writing transistor 23 is held in the holding capacitor 25.

The driving transistor 22 operates in a saturation area to supply a driving current having a current value corresponding to the voltage value of the signal voltage $V_{sig}$ held in the holding capacitor 25 to the organic EL element 21 to current-drive the organic EL element 21, so that the organic EL element 21 emits light. The switching transistor 24 enters a conduction state in response to the drive scanning signal AZ whose high voltage state becomes an active state, which is applied from the drive scanning unit 50 to the gate electrode via the driving line 32. Accordingly, the switching transistor 24 applies the fixed potential $V_{ss}$ satisfying the relationship of $V_{ss}<V_{cath}+V_{th_EL}$ to the source electrode of the driving transistor 22 and the anode electrode of the organic EL element 21. In other words, the switching transistor 24 is a reset transistor that resets a source potential of the driving transistor 22 and an anode potential of the organic EL element 21 to the fixed potential $V_{ss}$.

Each pixel 20 of the pixel array unit 30 has a function of correcting a variation in driving current caused by a variation in a characteristic of the driving transistor 22. Examples of the characteristic of the driving transistor 22 may include the threshold voltage $V_{th}$ of the driving transistor 22, and mobility u of a semiconductor thin film constituting a channel of the driving transistor 22 (hereinafter referred to simply as "mobility u of the driving transistor 22").

The correction of the variation in driving current caused by the variation in threshold voltage $V_{th}$ (hereinafter referred to also as "threshold correction") is performed by initializing the gate voltage $V_g$ of the driving transistor 22 to be the reference voltage $V_{ofs}$. Specifically, an operation for changing the source voltage V, of the driving transistor 22 to be a potential resulting from subtraction of the threshold voltage $V_{th}$ of the driving transistor 22 from an initialization potential (reference voltage $V_{ofs}$) of the gate voltage $V_g$ of the driving transistor 22 based on the initialization potential is performed. When this operation progresses, a voltage $V_{gs}$ between the gate and the source of the driving transistor 22 converges into the threshold voltage $V_{th}$ of the driving transistor 22. A voltage corresponding to this threshold voltage $V_{th}$ is held in the holding capacitor 25. Also, since the voltage corresponding to the threshold voltage $V_{th}$ is held in the holding capacitor 25, it is possible to suppress dependence on the threshold voltage $V_{th}$ of a current $I_{ds}$ between the drain and the source that flows in the driving transistor 22 when the driving transistor 22 is driven by the signal voltage $V_{sig}$ of the video signal.

On the other hand, the correction of the variation in the driving current caused by the variation in the mobility u (hereinafter referred to also as "mobility correction") is performed by flowing a current to the holding capacitor 25 via the driving transistor 22 in a state in which the writing transistor 23 enters conduction state and the signal voltage $V_{sig}$ of the video signal is written. In other words, the correction is performed by applying negative feedback to the holding capacitor 25 with a feedback amount (correction amount) corresponding to the current $I_{ds}$ flowing in the driving transistor 22. Through the threshold correction described above, the dependence on the threshold voltage $V_{th}$ of the current $I_{ds}$ between the drain and the source has already been removed when the video signal is written, and the current $I_{ds}$ between the drain and the source depends on the mobility u of the driving transistor 22. Therefore, negative feedback is applied to the voltage $V_{ds}$ between the drain and the source of the driving transistor 22 with a feedback amount according to the current $I_{ds}$ flowing in the driving transistor 22, thus making it possible to suppress the dependence on the mobility u of the current $I_{ds}$ between the drain and the source flowing in the driving transistor 22.

Driving Method According to a Comparative Example

Figure 3:
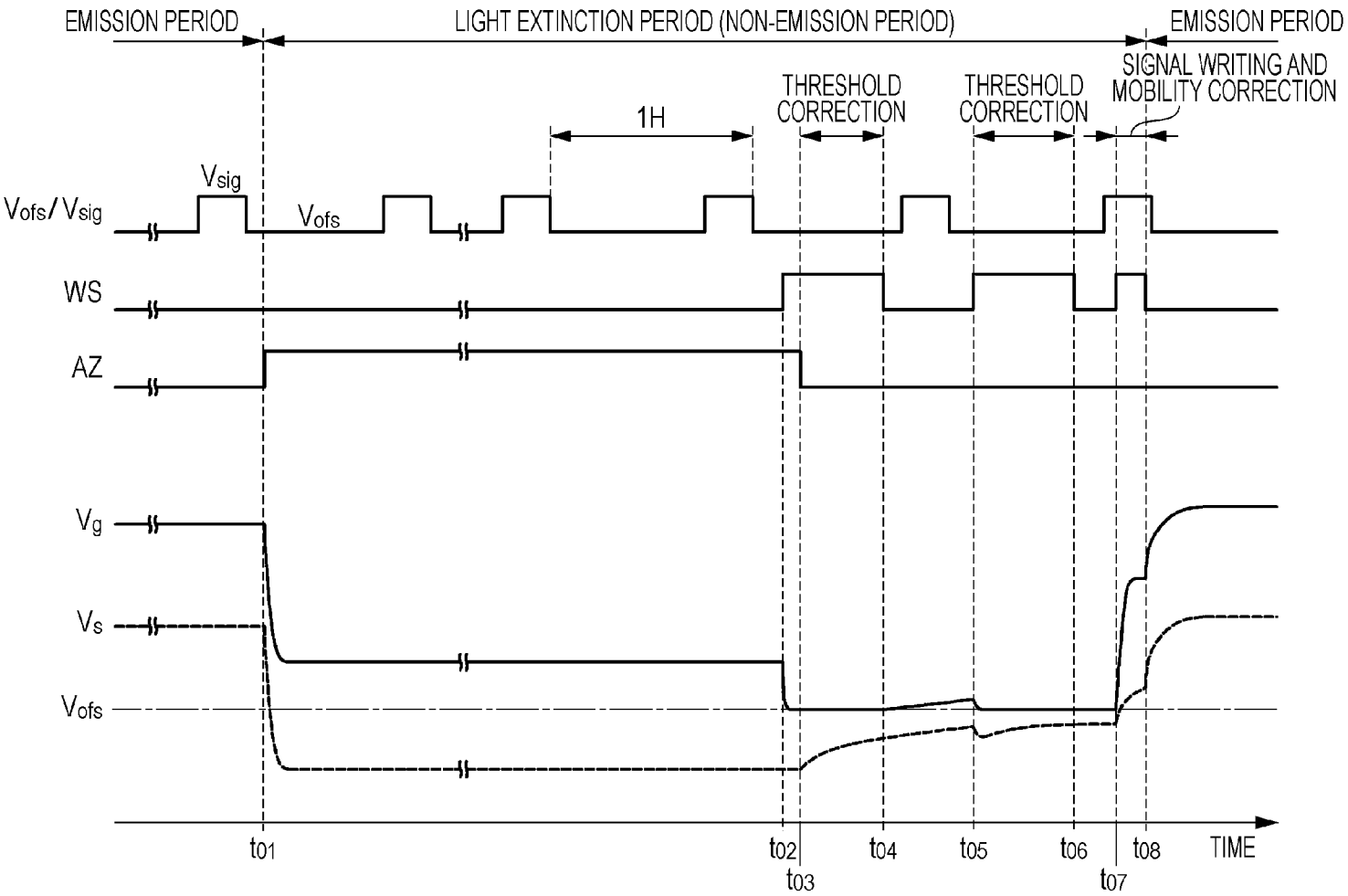
FIG. 3 is a timing waveform diagram illustrating an operation of a method of driving an organic EL display device according to a comparative example.

Here, for a method of driving the active matrix organic EL display device 10 having the configuration described above, a technology existing before the technology of the present disclosure (that is, a driving method according to an embodiment) will be briefly described as a method of driving an organic EL display device 10 according to a comparative example using a timing waveform diagram of FIG. 3.

A state of change in each of the potential $V_{ofs}/V_{sig}$ of the signal line 33, the write scanning signal WS, the drive scanning signal AZ, and the gate voltage $V_g$ and the source voltage $V_s$ of the driving transistor 22 are shown in the timing waveform diagram of FIG. 3. In addition, a waveform of the source voltage $V_s$ of the driving transistor 22 is indicated by a dashed line. The potential of the signal line 33 is switched between the reference voltage $V_{ofs}$ and the signal voltage $V_{sig}$ in a 1 horizontal period (1H).

In addition, since the writing transistor 23 and the switching transistor 24 are N channel type transistors, high voltage states of the write scanning signal WS and the drive scanning signal AZ are active states, and low voltage states are inactive states. Also, the writing transistor 23 and the switching transistor 24 enter a conduction state in the active states of the write scanning signal WS and the drive scanning signal AZ, and enter a non-conduction state in the inactive states thereof.

In the timing waveform diagram of FIG. 3, a period up to time $t_{01}$ is an emission period of the organic EL element 21 in a previous display frame. When the time $t_{01}$ arrives, the organic EL element 21 is extinguished, and a light extinction period (non-emission period) of a new display frame (current display frame) of line sequential scanning starts. Also, a first threshold correction is performed in a period from time $t_{03}$ to time $t_{04}$, a second threshold correction is performed in a period from time $t_{05}$ to time $t_{06}$, and writing of the video signal and mobility correction are performed in a period from time $t_{07}$ to time $t_{08}$.

In the driving method according to the comparative example, the drive scanning signal AZ enters an active state at time $t_{01}$ and thus the switching transistor 24 enters a conduction state. Accordingly, the fixed potential $V_{ss}$ lower than $V_{cath}+V_{th_EL}$ is written to the anode electrode of the organic EL element 21 (the source electrode of the driving transistor 22) by the switching transistor 24, thus extinguishing the organic EL element 21.

Figure 4:
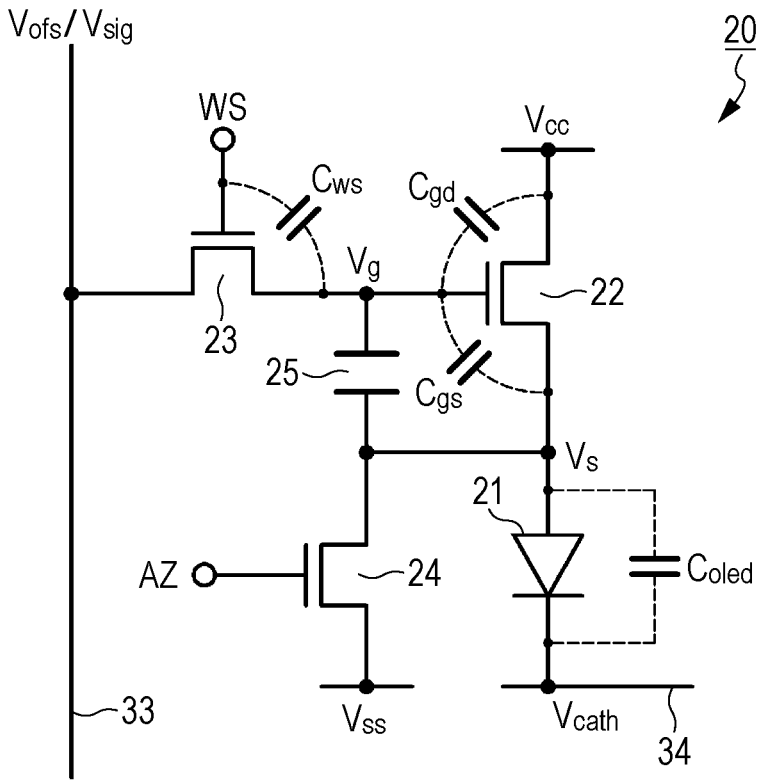
FIG. 4 is an equivalent circuit diagram of a pixel circuit illustrating an expression of a bootstrap gain $G_{bst}$.

Here, a ratio of a change amount $\Delta V_g$ of the gate voltage $V_g$ to a change amount $\Delta V_s$ of the source voltage $V_s$ of the driving transistor 22 (hereinafter referred to as a bootstrap gain $G_{bst}$) is considered. A capacitance value of a parasitic capacitor between the gate electrode and the source electrode of the driving transistor 22 is $C_{gs}$, a capacitance value of a parasitic capacitor between the gate electrode and the drain electrode is $C_{gd}$, and a capacitance value of a parasitic capacitor between the gate electrode and the other electrode (the electrode on the driving transistor 22 side) of the writing transistor 23 is $C_{ws}$, as illustrated in FIG. 4. In addition, a capacitance value of the holding capacitor 25 is $C_s$.

In this case, the bootstrap gain $G_{bst}$ can be expressed as:

$$G_{bst} = \Delta V_g / \Delta V_s = (C_s + C_{gs})/(C_s + C_{ws} + C_{gd} + C_{gs}) \quad (1)$$

In Expression (1), since the respective capacitance values $C_{ws}$, $C_{gd}$ and $C_{gs}$ of the parasitic capacitors are sufficiently smaller than capacitance value $C_s$ of the holding capacitor 25, the bootstrap gain $G_{bst}$ generally has a value close to 1.

Here, in the driving method according to the comparative example, a configuration in which the switching transistor 24 enters a conduction state, the fixed potential $V_{ss}$ is applied to the source electrode of the driving transistor 22, and thus a light extinction period of the organic EL element 21 arrives is adopted. However, in the light extinction period of the organic EL element 21, since a period of time in which the driving transistor 22 and the switching transistor 24 enter a conduction state together increases, a lot of through current flows from the driving transistor 22 via the switching transistor 24. As a result, a lot of unutilized power that does not contribute to the light emission of the organic EL element 21 is consumed.

Description of Embodiments

In the driving method according to the comparative example, a timing of the start of the light extinction period (end of the emission period) is defined as a timing at which the drive scanning signal AZ for driving the switching transistor 24 enters an active state, that is, a timing at which the fixed potential $V_{ss}$ is written to the source electrode of the driving transistor 22. In contrast, in the embodiment of the present disclosure, the timing of the start of the light extinction period (end of the emission period) is defined as a timing to write a voltage causing the driving transistor 22 to enter a non-conduction state to the gate electrode of the driving transistor 22.

More specifically, in the present embodiment, the write scanning signal WS enters an active state so that the writing transistor 23 enters a conduction state, and the voltage causing the driving transistor 22 to enter a non-conduction state is written to the gate electrode of the driving transistor 22 so that the organic EL element 21 enters a light extinction state. The reference voltage $V_{ofs}$ that is used when the threshold voltage of the driving transistor 22 is corrected may be used as the voltage causing the driving transistor 22 to enter a non-conduction state. However, this is an example and the present disclosure is not limited to the reference voltage $V_{ofs}$.

When the voltage causing the driving transistor 22 to enter a non-conduction state is written to the gate electrode of the driving transistor 22, the driving transistor 22 enters a non-conduction state, the emission period of the organic EL element 21 ends, and the light extinction period arrives. In other words, the timing of start of the light extinction period (end of the emission period) is defined as a timing at which the writing transistor 23 enters a conduction state, that is, the write scanning signal WS enters an active state, which is not a time at which the switching transistor 24 enters a conduction state, that is, the drive scanning signal AZ enters an active state.

Also, when the light extinction period arrives, the driving transistor 22 enters a non-conduction state, and thus a through current does not flow from the driving transistor 22 to the node for a fixed potential $V_{ss}$ via the switching transistor 24. Therefore, in the light extinction period, the through current to the node for a fixed potential $V_{ss}$ via the switching transistor 24 can be suppressed, and thus it is possible to suppress consumption of unutilized power that does not contribute to the light emission of the organic EL element 21.

Hereinafter, a specific embodiment for suppressing a through current flowing from the driving transistor 22 to the node for a fixed potential $V_{ss}$ via the switching transistor 24 in a light extinction period will be described.

Embodiment 1

A method of driving an organic EL display device 10 according to Embodiment 1 will be described using a timing waveform diagram of FIG. 5.

Figure 5:
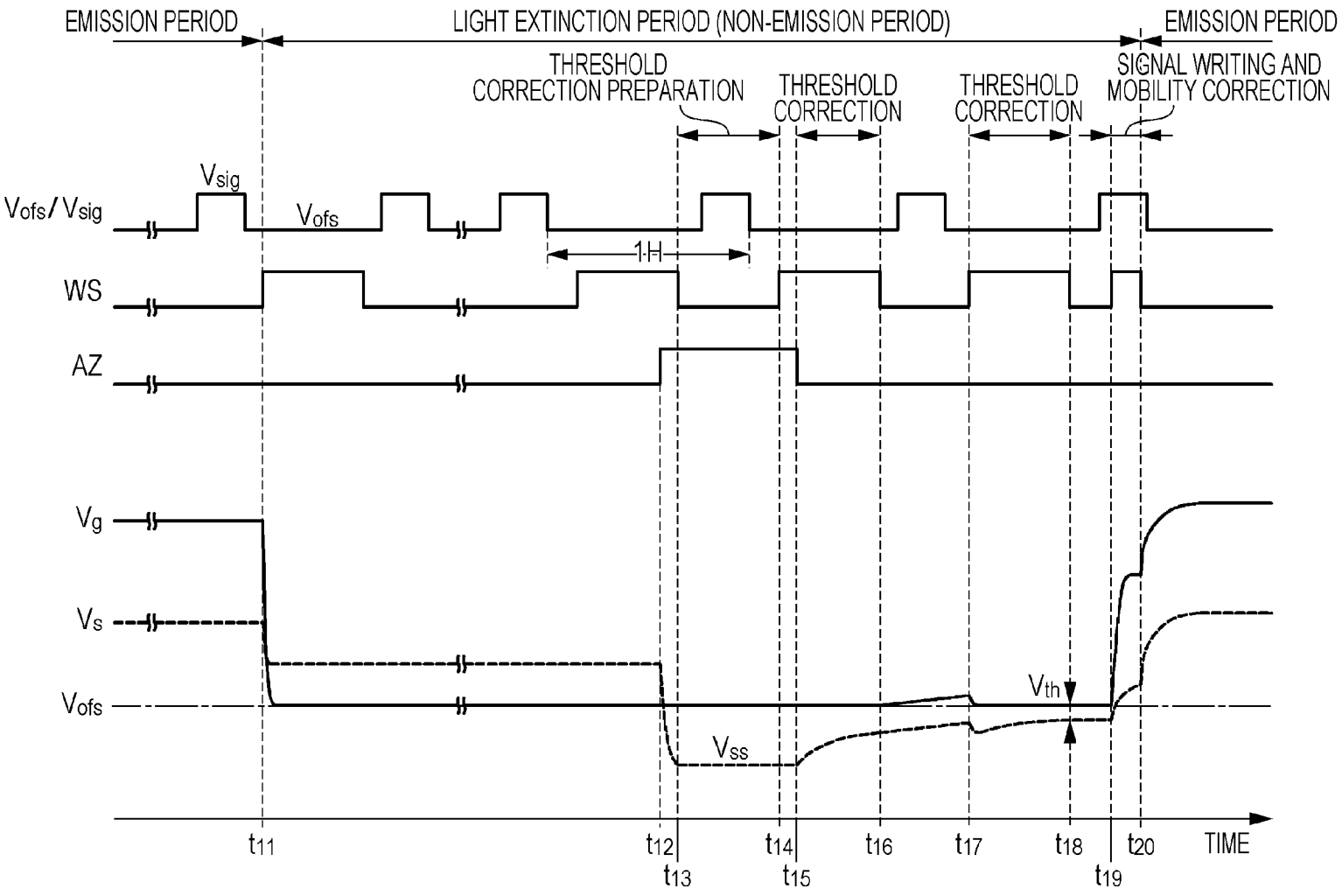
FIG. 5 is a timing waveform diagram illustrating an operation of a method of driving an organic EL display device according to Embodiment 1.

A state of change in each of the potential $V_{ofs}/V_{sig}$ of the signal line 33, the write scanning signal WS, the drive scanning signal AZ, and a gate voltage $V_g$ and a source voltage $V_s$ of the driving transistor 22 is illustrated in the timing waveform diagram of FIG. 5. In addition, the waveform of the source voltage $V_s$ of the driving transistor 22 is indicated by a dashed line. The potential of the signal line 33 is switched between the reference voltage $V_{ofs}$ and the signal voltage $V_{sig}$ in a 1 horizontal period (1H).

In addition, since the writing transistor 23 and the switching transistor 24 are N channel type transistors, a high voltage state of the write scanning signal WS and the drive scanning signal AZ becomes an active state, and a low voltage state thereof becomes an inactive state, as in the case of the driving method according to the comparative example. Also, the writing transistor 23 and the switching transistor 24 enter a conduction state in an active state of the write scanning signal WS and the drive scanning signal AZ, and enter a non-conduction state in an inactive state thereof. The same applies to Embodiments 2 and 3.

In the timing waveform diagram of FIG. 5, a period up to $t_{11}$ is an emission period of the organic EL element 21 in a previous display frame. When $t_{11}$ arrives, the write scanning signal WS enters an active state and the writing transistor 23 enters a conduction state. In this case, the reference voltage $V_{ofs}$ that is used at the time of threshold correction is supplied from the signal output unit 60 to the signal line 33. Therefore, the writing transistor 23 writes the reference voltage $V_{ofs}$ to the gate electrode of the driving transistor 22 as a voltage causing the driving transistor 22 to enter a non-conduction state.

Here, the reference voltage $V_{ofs}$ is a voltage that is a reference of the signal voltage $V_{sig}$ of the video signal, such as a voltage corresponding to the black level of the video signal. In other words, the reference voltage $V_{ofs}$ is the voltage causing the driving transistor 22 to enter a non-conduction state. Therefore, when the reference voltage $V_{ofs}$ is written to the gate electrode of the driving transistor 22, the driving transistor 22 enters a non-conduction state and supply of a current to the organic EL element 21 stops, thereby extinguishing the organic EL element 21. Also, a light extinction period (non-emission period) of a new display frame (current display frame) of the line sequential scanning arrives. In this case, the drive scanning signal AZ for driving the switching transistor 24 is in the inactive state. Here, the reference voltage $V_{ofs}$ can also be set to the same voltage as the cathode potential $V_{cath}$ of the organic EL element 21.

In the light extinction period, the drive scanning signal AZ enters an active state at time $t_{12}$ at which the write scanning signal WS is in the active state again. In response thereto, the switching transistor 24 enters a conduction state and the fixed potential $V_{ss}$ is written to the source electrode of the driving transistor 22. Accordingly, since the source voltage $V_s$ of the driving transistor 22 is the fixed potential $V_{ss}$ in a state in which the gate voltage $V_g$ of the driving transistor 22 is the reference voltage $V_{ofs}$, the voltage $V_{gs}$ between the gate and the source of the driving transistor 22 is $V_{ofs}-V_{ss}$. When the voltage $V_{gs}$ between the gate and the source of the driving transistor 22 is not higher than the threshold voltage $V_{th}$ of the driving transistor 22, it is difficult to perform the threshold correction process and thus, the fixed potential $V_{ss}$ is set to satisfy a potential relationship of $V_{ofs}-V_{ss}>V_{th}$.

Thus, the process of fixing the gate voltage $V_g$ of the driving transistor 22 to the reference voltage $V_{ofs}$ and fixing (settling) the source voltage $V_s$ to the fixed potential $V_{ss}$ for initialization is a process of preparation before the threshold correction process (threshold correction operation) is performed (threshold correction preparation). Therefore, the reference voltage $V_{ofs}$ and the fixed potential $V_{ss}$ become respective initialization voltages of the gate voltage $V_g$ and the source voltage $V_s$ of the driving transistor 22. Also, a period from time $t_{13}$ at which the write scanning signal WS enters an inactive state to time $t_{14}$ at which the write scanning signal WS enters an active state again is a threshold correction preparation period.

Then, at time $t_{15}$, when the drive scanning signal AZ enters the inactive state and the switching transistor 24 enters a non-conduction state, the threshold correction process starts in a state in which the gate voltage $V_g$ of the driving transistor 22 is held at the reference voltage $V_{ofs}$. In other words, the source voltage $V_s$ of the driving transistor 22 starts to increase to a voltage resulting from subtraction of the threshold voltage $V_{th}$ of the driving transistor 22 from the gate voltage $V_g$. A period from time $t_{15}$ to time $t_{16}$ at which the write scanning signal WS enters an inactive state is a first threshold correction period. A second threshold correction process is then performed in a period from $t_{17}$ at which the write scanning signal WS enters an active state to time $t_{18}$.

When the threshold correction process progresses, the voltage $V_{gs}$ between the gate and the source of the driving transistor 22 converges into the threshold voltage $V_{th}$ of the driving transistor 22. A voltage corresponding to this threshold voltage $V_{th}$ is held in the holding capacitor 25. In addition, during a period in which the threshold correction process is performed (a threshold correction period), a potential of the common power supply line 34, that is, the cathode potential $V_{cath}$ is set so that the organic EL element 21 enters a cut-off state, in order for a current to flow to only the holding capacitor 25 and not to flow to the organic EL element 21.

Then, at time $t_{19}$, the write scanning signal WS enters an active state in a state in which the signal voltage $V_{sig}$ of the video signal has been supplied from the signal output unit 60 to the signal line 33. In response thereto, the writing transistor 23 enters a conduction state, and thus the signal voltage $V_{sig}$ of the video signal is sampled and written to the gate electrode of the driving transistor 22. As the signal voltage $V_{sig}$ is written by the writing transistor 23, the gate voltage $V_g$ of the driving transistor 22 becomes a signal voltage $V_{sig}$. Also, when the driving transistor 22 is driven by the signal voltage $V_{sig}$ of the video signal, the threshold voltage $V_{th}$ of the driving transistor 22 is offset by a voltage corresponding to the threshold voltage $V_{th}$ held in the holding capacitor 25, thus suppressing dependence on the threshold voltage $V_{th}$ of the current $I_{ds}$ between the drain and the source flowing in the driving transistor 22.

In this case, a current (current $I_{ds}$ between the drain and the source) flowing from a node for the power supply voltage $V_{cc}$ to the driving transistor 22 according to the signal voltage $V_{sig}$ of the video signal flows to the equivalent capacitor $C_{oled}$ of the organic EL element 21. Accordingly, charge of the equivalent capacitor $C_{oled}$ of the organic EL element 21 starts.

The source voltage $V_s$ of the driving transistor 22 increases over time due to the charge of the equivalent capacitor $C_{oled}$ of the organic EL element 21. In this case, a variation in driving current caused by a variation in the threshold voltage $V_{th}$ of the driving transistor 22 of each pixel has already been corrected, and the current $I_{ds}$ between the drain and the source of the driving transistor 22 depends on the mobility u of the driving transistor 22.

Here, when it is assumed that a ratio of a change amount $\Delta V_s$ of the source voltage $V_s$ of the driving transistor 22 to a change amount $\Delta V_g$ of the gate voltage $V_g$ (hereinafter referred to as a writing gain $G_{in}$) is 0 (ideal value), the source voltage $V_s$ of the driving transistor 22 increases by $\Delta V$, and thus the voltage $V_g$, between the gate and the source of the driving transistor 22 is $V_{sig}-V_{ofs}+V_{th}-\Delta V$.

In other words, the amount of increase $\Delta V$ of the source voltage $V_s$ of the driving transistor 22 acts so as to be subtracted from the voltage $(V_{sig}-V_{ofs}+V_{th})$ held in the holding capacitor 25, that is, so that charged charges of the holding capacitor 25 are discharged. In other words, the increase amount $\Delta V$ of the source voltage $V_s$ is negative feedback applied to the holding capacitor 25. Therefore, the increase amount $\Delta V$ of the source voltage $V_s$ becomes a feedback amount of the negative feedback.

Thus, the negative feedback is applied to the holding capacitor 25 with the feedback amount $\Delta V$ according to the current $I_{ds}$ between the drain and the source flowing to the driving transistor 22, thus suppressing dependence on the mobility u of the current $I_{ds}$ between the drain and the source of the driving transistor 22. This process of suppressing the dependence is a mobility correction process of correcting the variation in the driving current caused by the variation in the mobility u of the driving transistor 22 for each pixel.

More specifically, since the current $I_{ds}$ between the drain and the source increases as a signal amplitude $V_{in}$ ($=V_{sig}-V_{ofs}$) of the video signal written to the gate electrode of the driving transistor 22 becomes higher, an absolute value of the feedback amount ΔV of the negative feedback increases. Therefore, a mobility correction process is performed according to a signal amplitude $V_{in}$ of the video signal, that is, an emission luminance level. In addition, when the signal amplitude $V_{in}$ of the video signal is constant, the absolute value of the feedback amount ΔV of the negative feedback increases as the mobility u of the driving transistor 22 increases, thereby suppressing the variation in the driving current caused by the variation in the mobility u for each pixel.

Then, at time $t_{20}$, the write scanning signal WS enters an inactive state and the writing transistor 23 enters a non-conduction state in response thereto, thereby electrically disconnecting the gate electrode of the driving transistor 22 from the signal line 33 to enter a floating state. Here, when the gate electrode of the driving transistor 22 is in the floating state, the gate voltage $V_g$ of the driving transistor 22 changes in conjunction with a change in the source voltage $V_s$ due to the holding capacitor 25 being connected between the gate and the source of the driving transistor 22. Thus, the operation in which the gate voltage $V_g$ of the driving transistor 22 changes in conjunction with the change in the source voltage $V_s$ is a bootstrap operation.

The gate electrode of the driving transistor 22 enters the floating state and, at the same time, the current $I_{ds}$ between the drain and the source of the driving transistor 22 begins to flow to the organic EL element 21, thereby increasing the anode voltage of the organic EL element 21 according to the current $I_{ds}$. Also, when the anode voltage of the organic EL element 21 exceeds $V_{th_EL}+V_{cath}$, the driving current begins to flow to the organic EL element 21 and thus the organic EL element 21 starts to emit light.

In addition, an increase in the anode voltage of the organic EL element 21 is nothing but an increase in the source voltage $V_s$ of the driving transistor 22. Also, if the source voltage $V_s$ of the driving transistor 22 increases, the gate voltage $V_g$ of the driving transistor 22 also increases in conjunction with the increase in the source voltage due to the bootstrap operation. In this case, if the bootstrap gain $G_{bst}$ is assumed to be 1 (ideal value), the increase amount of the gate voltage $V_g$ is equal to an increase amount of the source voltage Vs. Thus, in the emission period, the voltage $V_{gs}$ between the gate and the source of the driving transistor 22 is maintained to be constant at $V_{sig}-V_{ofs}+V_{th}-\Delta V$.

In the series of operations described above, in the method of driving the organic EL display device 10 according to Embodiment 1, the timing of start of the light extinction period (end of the emission period) is defined as a timing to write the voltage causing the driving transistor 22 to enter a non-conduction state, such as the reference voltage $V_{ofs}$, to the gate electrode of the driving transistor 22. In Embodiment 1, a timing to write the reference voltage $V_{ofs}$ may be a timing at which the write scanning signal WS for driving the writing transistor 23 enters an active state.

Figure 6:
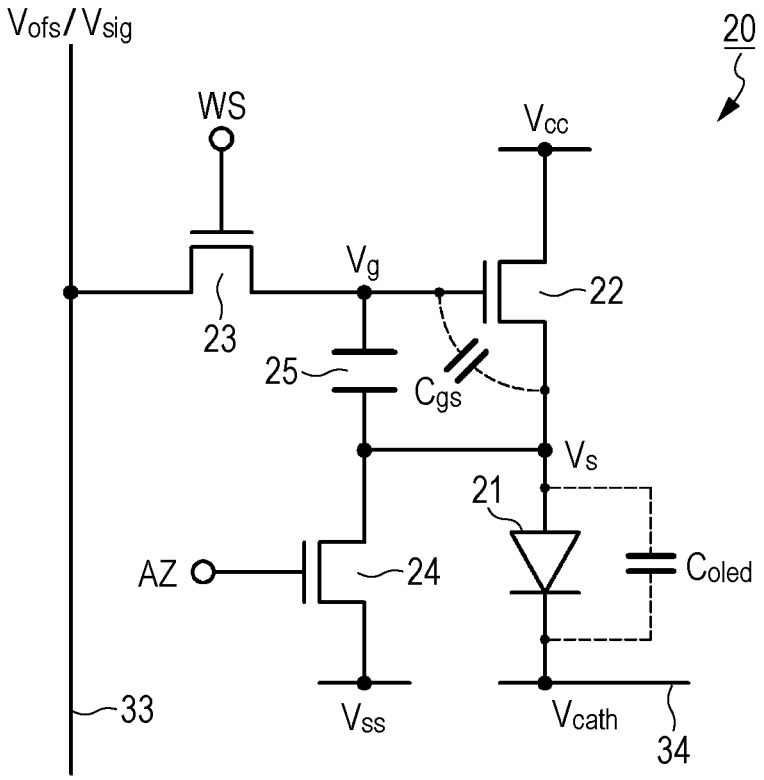
FIG. 6 is an equivalent circuit diagram of a pixel circuit illustrating an expression of a writing gain $G_{in}$.

As illustrated in FIG. 6, a capacitance value of the parasitic capacitor between the gate electrode and the source electrode of the driving transistor 22 is $C_{gs}$, a capacitance value of the holding capacitor 25 is $C_s$, and a capacitance value of the equivalent capacitance of the organic EL element 21 is $C_{oled}$. In this case, the ratio of a change amount $\Delta V_s$ of the source voltage $V_s$ to a change amount $\Delta V_g$ of the gate voltage $V_g$ of the driving transistor 22, that is, a writing gain $G_{in}$ is expressed as Expression (2) below.

$$G_{in} = \Delta V_s / \Delta V_g = (C_s + C_{gs})/(C_s + C_{gs} + C_{oled}) \quad (2)$$

Here, if $G_{in} \cong 0$ from $C_{oled} >> C_s$ and $C_{oled} >> C_{gs}$, when the reference voltage $V_{ofs}$, is set to a voltage lower than $V_{th_EL}+V_{cath}+V_{th_Drv}$ or when the reference voltage $V_{ofs}$ is set to a voltage equal to or lower than $V_{cath}$, the reference voltage $V_{ofs}$ is written to the gate electrode of the driving transistor 22 at the time of start of the light extinction period (at the time of end of the emission period) and thus the voltage $V_{gs}$ between the gate and the source of the driving transistor 22 is lower than the threshold voltage $V_{th_Drv}$ of the driving transistor 22. Accordingly, the driving transistor 22 enters a non-conduction state. In this case, the switching transistor 24 also enters a non-conduction state. Therefore, a current (through current) does not flow from the driving transistor 22 to the node for a fixed potential $V_{ss}$ via the switching transistor 24. Accordingly, in the light extinction period other than the threshold correction preparation period (from time $t_{13}$ to time $t_{14}$), the through current flowing from the driving transistor 22 to the node for a fixed potential $V_{ss}$ via the switching transistor 24 can be suppressed and thus consumption of unutilized power that does not contribute to the emission of the organic EL element 21 can be suppressed.

Embodiment 2

A method of driving an organic EL display device 10 according to Embodiment 2 will be described using a timing waveform diagram of FIG. 7.

Figure 7:
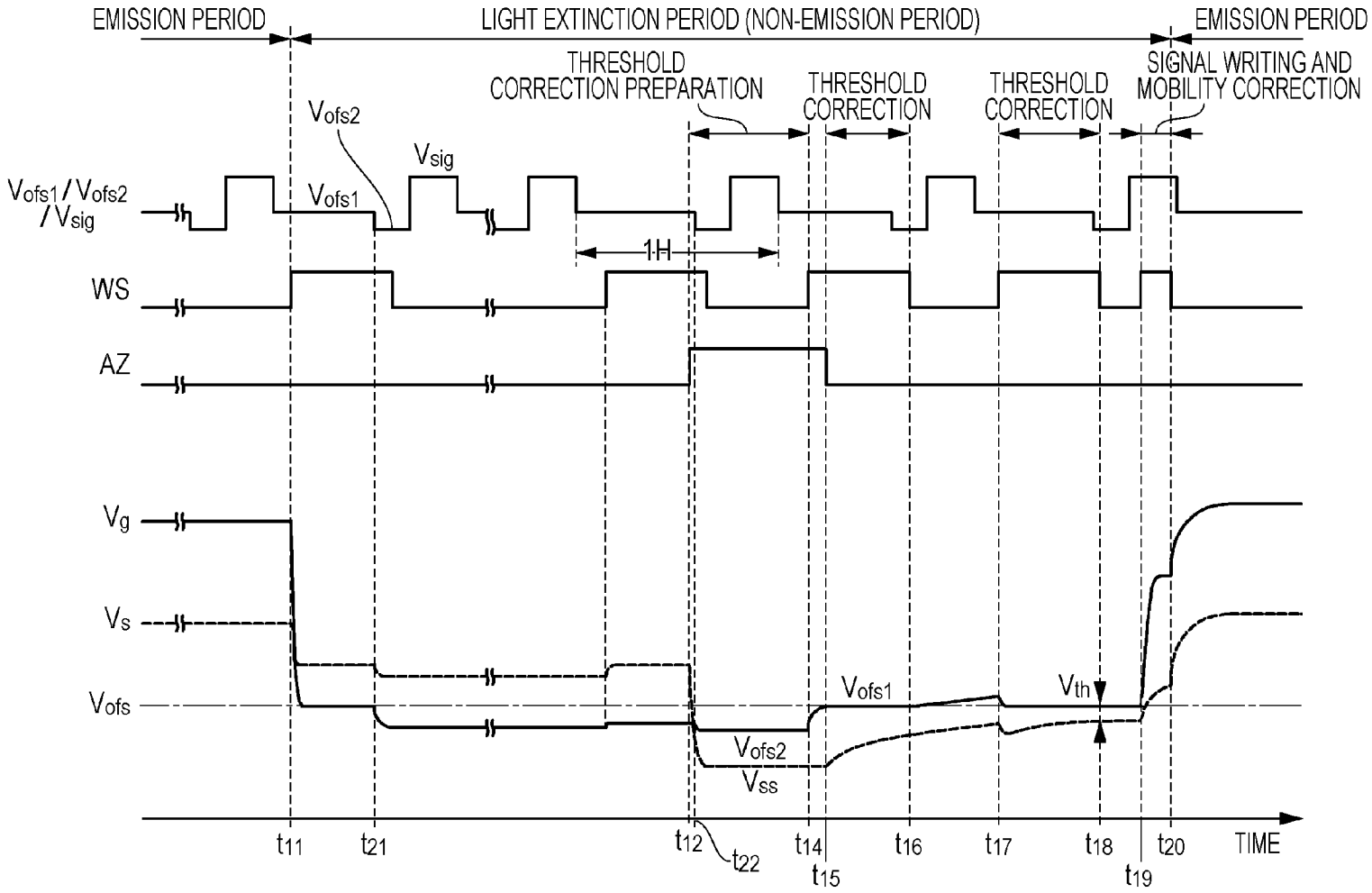
FIG. 7 is a timing waveform diagram illustrating an operation of a method of driving an organic EL display device according to Embodiment 2.

A state of change in each of the potential $V_{ofs1}/V_{ofs2}/V_{sig}$ of the signal line 33, the write scanning signal WS, the drive scanning signal AZ, and the gate voltage $V_g$ and the source voltage $V_s$ of the driving transistor 22 is shown in the timing waveform diagram of FIG. 7. In addition, a waveform of the source voltage $V_s$ of the driving transistor 22 is indicated by a dashed line.

In Embodiment 2, the following configuration is adopted, in addition to definition of the timing of the start of the light extinction period as the timing at which the voltage causing the driving transistor 22 to enter a non-conduction state is written to the gate electrode of the driving transistor 22, as in Embodiment 1. That is, in Embodiment 2, a configuration in which a voltage lower than the voltage causing the driving transistor 22 to enter a non-conduction state is written to the gate electrode of the driving transistor 22 when the switching transistor 24 is in a conduction state is adopted.

Here, the threshold voltage $V_{th}$ of the driving transistor 22 is $V_{th_Drv}$. In this case, a voltage written to the gate electrode of the driving transistor 22 in the conduction state of the switching transistor 24 is a voltage lower than ($V_{th_Drv}+V_{ss}$). In Embodiment 2, a reference voltage $V_{ofs}$ is used as the voltage causing the driving transistor 22 to enter a non-conduction state, as in Embodiment 1. Therefore, the voltage written to the gate electrode of the driving transistor 22 in the conduction state of the switching transistor 24 is a voltage lower than the reference voltage $V_{ofs}$. Hereinafter, the reference voltage $V_{ofs}$ is $V_{ofs1}$ and the voltage lower than the reference voltage $V_{ofs}$ is $V_{ofs2}$.

Even in Embodiment 2, the reference voltage $V_{ofs2}$ is assumed to be supplied from the signal output unit 60 via the signal line 33 like the reference voltage $V_{ofs1}$. Accordingly, a potential of the signal line 33 takes 3 values of the reference voltage $V_{ofs1}$/the reference voltage $V_{ofs2}$/the signal voltage $V_{sig}$ of the video signal. Also, the reference voltage $V_{ofs1}$/the reference voltage $V_{ofs2}$/the signal voltage $V_{sig}$ are written to the gate electrode of the driving transistor 22 by the writing transistor 23.

In addition, here, the reference voltage $V_{ofs2}$ output from the signal output unit 60 is used as the voltage to be written to the gate electrode of the driving transistor 22 in the conduction state of the switching transistor 24, but the present disclosure is not limited thereto. For example, the fixed potential $V_{ss}$ can also be used as the voltage to be written to the gate electrode of the driving transistor 22 in the conduction state of the switching transistor 24 as long as the threshold voltage $V_{th_Drv}$ of the driving transistor 22 is $V_{th_Drv}>0$. The use of the fixed potential $V_{ss}$ makes it unnecessary to separately generate the reference voltage $V_{ofs2}$, and thus there is an advantage that the use of the fixed potential is advantageous in achieving the simplification of the system.

In a concrete operation of Embodiment 2, a timing of the start of the light extinction period (end of the emission period) is defined as a timing (time $t_{11}$) to write the reference voltage $V_{ofs1}$ to the gate electrode of the driving transistor 22, as in Embodiment 1. Also, the potential of the signal line 33 is switched from the reference voltage $V_{ofs1}$ to the reference voltage $V_{ofs2}$ at time $t_{21}$ in the active period of the write scanning signal WS, as illustrated in the timing waveform diagram of FIG. 7. With this, the gate voltage $V_g$ and the source voltage $V_s$ of the driving transistor 22 decrease.

In the light extinction period, the drive scanning signal AZ enters an active state at time $t_{12}$ in which the write scanning signal WS is in the active state again. In response thereto, the switching transistor 24 enters a conduction state and writes the fixed potential $V_{ss}$ to the source electrode of the driving transistor 22. Accordingly, initialization of the gate voltage $V_g$ and source voltage $V_s$ of the driving transistor 22 is performed and a threshold correction preparation period arrives.

Then, the potential of the signal line 33 is switched from the reference voltage $V_{ofs1}$ to the reference voltage $V_{ofs2}$ at time $t_{22}$ in a period in which the drive scanning signal AZ is in an active state, that is, a period when the switching transistor 24 is in a conduction state. Accordingly, the reference voltage $V_{ofs2}$ is sampled by the writing transistor 23 and written to the gate electrode of the driving transistor 22. Then, in threshold correction, the write scanning signal WS enters an active state again at time $t_{14}$. In response thereto, the writing transistor 23 enters a conduction state, and thus the reference voltage $V_{ofs1}$ is written to the gate electrode of the driving transistor 22. Basically, a subsequent operation of first threshold correction, second threshold correction, and signal writing and mobility correction is performed as in Embodiment 1.

As described above, in Embodiment 2, the potential of the signal line 33 has 3 values of the reference voltage $V_{ofs1}$/the reference voltage $V_{ofs2}$/the signal voltage $V_{sig}$. Also, in the threshold correction preparation period, the reference voltage $V_{ofs2}$ satisfying the conditions of $V_{ofs2}<V_{ofs1}$ and $V_{ofs2}-V_{ss}<V_{th_Drv}$ is written to the gate electrode of the driving transistor 22. Since this driving makes the voltage $V_{gs}$ between the gate and the source of the driving transistor 22 lower than the threshold voltage $V_{th_Drv}$ it is possible to suppress the through current flowing to the node for a fixed potential $V_{ss}$ via the switching transistor 24 in the light extinction period other than the threshold correction period, that is, the threshold correction preparation period.

Embodiment 3

A method of driving an organic EL display device 10 according to Embodiment 3 will be described using a timing waveform diagram of FIG. 8.

Figure 8:
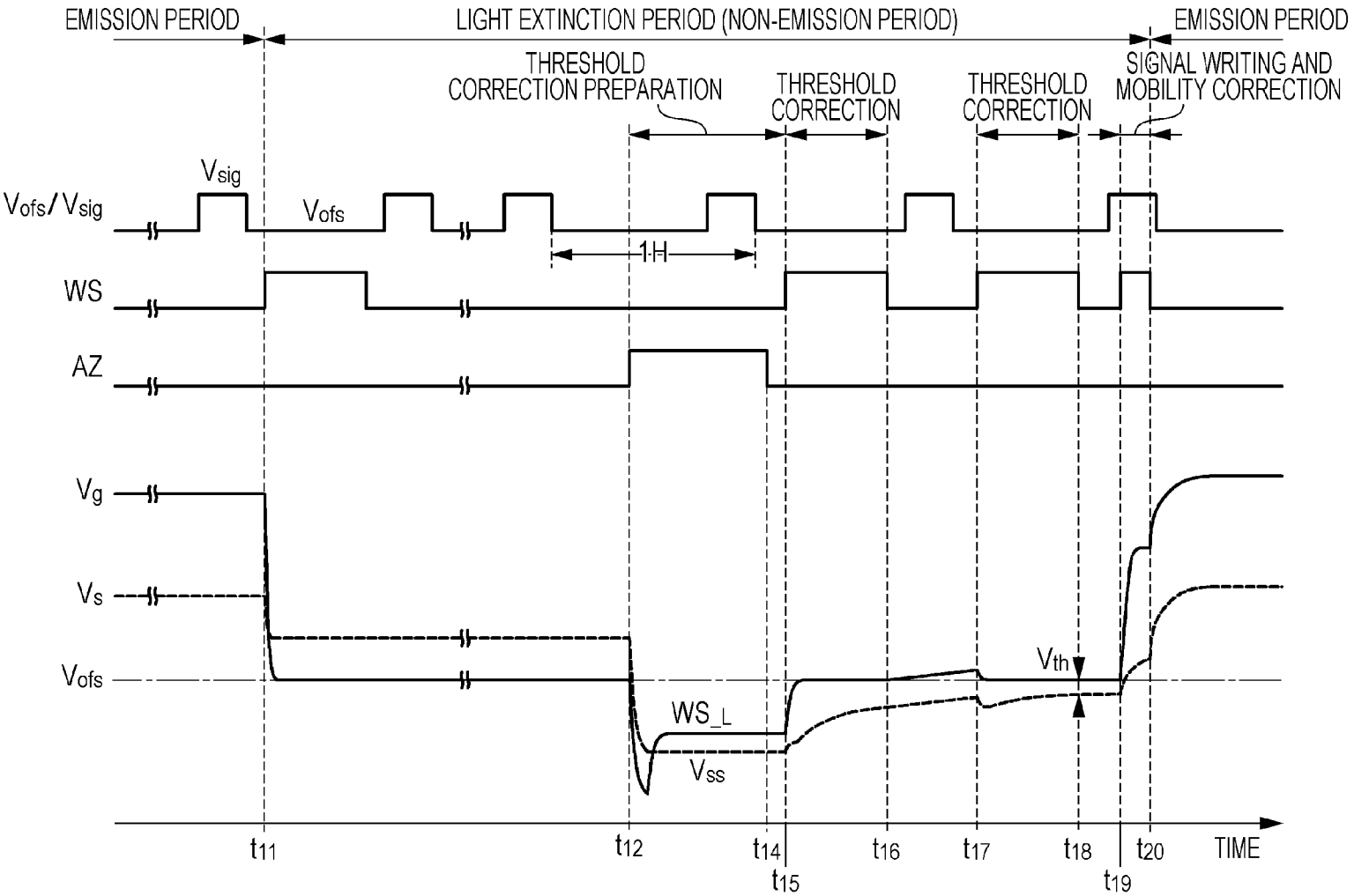
FIG. 8 is a timing waveform diagram illustrating an operation of a method of driving an organic EL display device according to Embodiment 3.

A state of change in each of the potential $V_{ofs}/V_{sig}$ of the signal line 33, the write scanning signal WS, the drive scanning signal AZ and the gate voltage $V_g$ and the source voltage $V_s$ of the driving transistor 22 is shown in a timing waveform diagram of FIG. 8. In addition, a waveform of the source voltage $V_s$ of the driving transistor 22 is indicated by a dashed line.

In Embodiments 1 and 2, a configuration in which the active period of the write scanning signal WS and the active period of the drive scanning signal AZ are overlapped before and after the threshold correction preparation period has been adopted. In contrast, in Embodiment 3, a configuration in which the active period of the write scanning signal WS and the active period of the drive scanning signal AZ are not overlapped in the threshold correction preparation period and before and after the period is adopted.

Also, in Embodiment 3, the voltage causing the writing transistor 23 to enter a non-conduction state, that is, a low voltage $WS_L$ of the write scanning signal WS is set to satisfy Expression (3) below. In other words, when the threshold voltage of the writing transistor 23 is $V_{th_WS}$ and the threshold voltage of the driving transistor 22 is $V_{th_Drv}$, the voltage $WS_L$ causing the writing transistor 23 to enter a non-conduction state is set to a voltage satisfying:

$$WS_L<V_{th_WS}+V_{th_Drv}+V_{ss} \quad (3)$$

Here, a reason for setting the voltage causing the writing transistor 23 to enter a non-conduction state, that is, the low voltage $WS_L$ of the write scanning signal WS to the voltage satisfying Expression (3) will be described.

In Embodiment 3, a configuration in which the active period of the write scanning signal WS and the active period of the drive scanning signal AZ are not overlapped in the threshold correction preparation period and before and after the period is adopted, as described above. Accordingly, as illustrated in the timing waveform diagram of FIG. 8, at time $t_{12}$, the drive scanning signal AZ enters an active state, the switching transistor 24 enters a conduction state in response thereto, and thus the fixed potential $V_{ss}$ is written to the source electrode of the driving transistor 22. Then, the gate voltage $V_g$ of the driving transistor 22 is greatly decreased according to a bootstrap gain $G_{bst1}$ due to capacitive coupling. In this case, the voltage $V_{gs}$ between the gate and the source of the driving transistor 22 is likely to be higher than the threshold voltage $V_{th_Drv}$ in accordance with the low voltage $WS_L$ of the write scanning signal WS, and the driving transistor 22 is likely to enter a conduction state.

In the threshold correction preparation period, if the driving transistor 22 enters a conduction state, a through current flows to the node for a fixed potential $V_{ss}$ via the switching transistor 24, and the gate electrode and the source electrode of the driving transistor 22 enter a floating state together from time $t_{14}$ at which the drive scanning signal AZ enters an inactive state to time $t_{15}$ at which the first threshold correction starts. Then, the voltage $V_{gs}$ between the gate and the source of the driving transistor 22 at the time of threshold correction is compressed relative to the threshold voltage $V_{th_Drv}$ through the bootstrap operation, and the correction is not likely to be applied. Thus, it is necessary to set the low voltage $WS_L$ of the write scanning signal WS to a voltage satisfying Expression (3).

Expression (3) is derived as follows. That is, in the threshold correction preparation period, the voltage $V_{gs}$ between the gate and the source of the driving transistor 22 may satisfy $V_{gs}<V_{th_Drv}$, that is, $V_g-V_{ss}<V_{th_Drv}$.

$WS_L-V_{th_WS}-V_{ss_Drv}$ is derived from $V_g=WE_L-V_{th_WS}$. Thus, the low voltage $WS_L$ of the write scanning signal WS may satisfy Expression (3).

As described above, in Embodiment 3, in the threshold correction preparation period and before and after the period, the low voltage $WS_L$ of the write scanning signal WS is set to the voltage satisfying Expression (3) without overlap of the active period of the write scanning signal WS and the active period of the drive scanning signal AZ. Also, the fixed potential $V_{ss}$ is applied to the source electrode of the driving transistor 22 via the switching transistor 24 before the reference voltage $V_{ofs}$ is written to the gate electrode of the driving transistor 22. Through this driving, the through current does not flow from the driving transistor 22 to the node for a fixed potential $V_{ss}$ via the switching transistor 24, and the through current theoretically is not generated.

Modification Example

While the technology of the present disclosure has been described above using the embodiments, the technology of the present disclosure is not limited to the range described in the embodiments described above. In other words, a variety of modifications or improvements can be made to the embodiments described above without departing from the gist of the technology of the present disclosure, and forms to which such modifications or the improvements have been made are included in the technical range of the technology of the present disclosure.

For example, while the driving circuit for driving the organic EL element 21 has a 3Tr/1C type circuit configuration in which three transistors 22, 23 and 24 and one capacitor 25 are included in the embodiment described above, the present disclosure is not limited thereto. The driving circuit can also have a 3Tr/2C type circuit configuration in which an auxiliary capacitor having one electrode connected to the anode electrode of the organic EL element 21 and the other electrode connected to the node for a fixed potential is added, as necessary, in order to compensate for the insufficient capacitance of the organic EL element 21 and increase a gain for writing a video signal to the holding capacitor 25.

Figure 9:
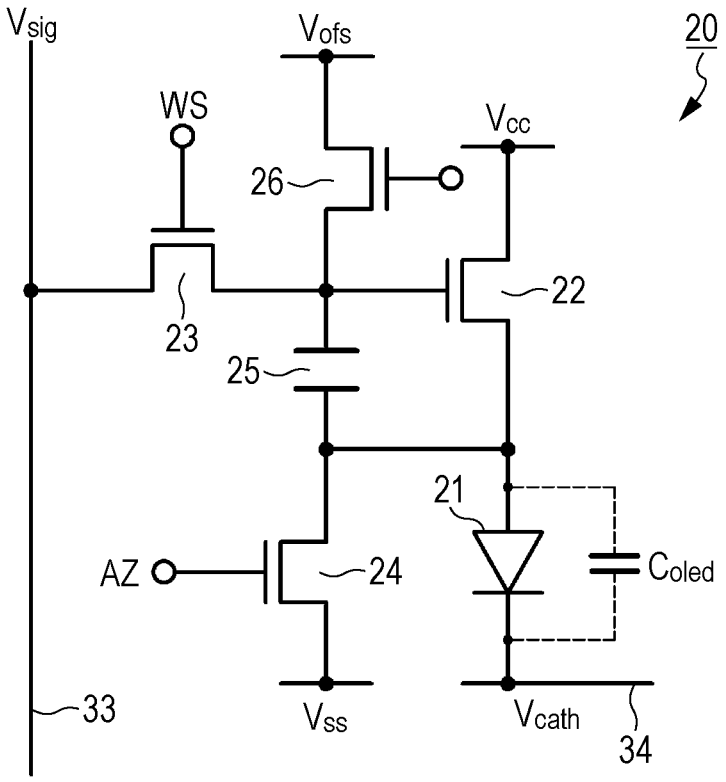
FIG. 9 is a circuit diagram illustrating a modification example of a pixel (pixel circuit).

In addition, the driving circuit can also have a 4Tr/1C type circuit configuration in which a switching transistor 26 that selectively applies the reference voltage $V_{ofs}$ to be used for threshold correction to the gate electrode of the driving transistor 22 is added, as illustrated in FIG. 9, or a 4Tr/2C type circuit configuration in which the auxiliary capacitor is further added. The driving circuit can also have a circuit configuration in which a constituent element such as a transistor is further added, as necessary.

Further, while an example in which the present disclosure is applied to the organic EL display device using the organic EL element as the electro-optic element of the pixel 20 has been described in the embodiments described above, the present disclosure is not limited to this application example. Specifically, the technology of the present disclosure is applicable to all display devices using a current-driven electro-optic element whose emission luminance changes according to a current value flowing in the device, such as an inorganic EL element, an LED element, and a semiconductor laser element.

Electronic Apparatus

The display device of the present disclosure described above can be used as a display unit (display device) for electronic apparatuses in all fields in which a video signal input to the electronic apparatus or a video signal generated in the electronic apparatus is displayed as an image or a video.

As apparent from the description of the embodiments described above, since the display device of the present disclosure can suppress the through current flowing to the node for a fixed potential $V_{ss}$ via the switching transistor 24 in the light extinction period, it is possible to suppress consumption of unutilized power that does not contribute to the light emission of the organic EL element 21. Therefore, in electronic apparatuses in all fields, the display device of the present disclosure is used as a display unit for the electronic apparatuses, thus contributing to low power consumption by the electronic apparatus.

Examples of the electronic apparatus using the display device of the present disclosure as a display unit may include a digital camera, a video camera, a game device, and a laptop type personal computer, in addition to a television system. In addition, the display device of the present disclosure can also be used as a display unit for an electronic apparatus, including a portable information device such as an electronic book device or an electronic watch, or a portable communication device such as a portable phone or a PDA.

In addition, the present disclosure can take the following configurations.

[1] A display device including a pixel array unit in which pixels are arranged, each pixel including a light emitting unit, a writing transistor that writes a video signal, a driving transistor that drives the light emitting unit based on the video signal written by the writing transistor, and a switching transistor that applies a fixed potential to one terminal of the light emitting unit; and a driving unit that causes the light emitting unit to enter a light extinction state by writing a voltage causing the driving transistor to enter a non-conduction state to a gate electrode of the driving transistor.

[2] The display device according to [1], wherein each pixel of the pixel array unit has a function of correcting a threshold voltage of the driving transistor.

[3] The display device according to [2], wherein the voltage causing the driving transistor to enter a non-conduction state is a reference voltage that is used when a threshold voltage is corrected.

[4] The display device according to [2] or [3], wherein the driving unit writes the voltage causing the driving transistor to enter a non-conduction state to a holding capacitor.

[5] The display device according to any one of [1] to [4], wherein the driving unit applies a fixed potential to a source electrode of the driving transistor via the switching transistor in a state in which the voltage causing the driving transistor to enter a non-conduction state is written to the gate electrode of the driving transistor.

[6] The display device according to [5], wherein the driving unit writes a voltage lower than the voltage causing the driving transistor to enter a non-conduction state to the gate electrode of the driving transistor when the switching transistor is in a conduction state.

[7] The display device according to [6], wherein, when a threshold voltage of the driving transistor is $V_{th_Drv}$ and a fixed potential applied to the source electrode of the driving transistor is $V_{ss}$, a voltage that is written to the gate electrode of the driving transistor in a conduction state of the switching transistor is lower than ($V_{th_Drv}+V_{ss}$).

[8] The display device according to [7], wherein a voltage that is written to the gate electrode of the driving transistor in a conduction state of the switching transistor is lower than a reference voltage that is used when a threshold voltage is corrected.

[9] The display device according to [8], wherein the driving unit writes the reference voltage that is used when a threshold voltage is corrected and a voltage lower than the reference voltage to the gate electrode of the driving transistor via the writing transistor.

[10] The display device according to any one of [2] to [4], wherein, when a threshold voltage of the writing transistor is $V_{th_WS}$, the threshold voltage of the driving transistor is $V_{th_Drv}$ and the fixed potential applied to a source electrode of the driving transistor is $V_{ss}$, a voltage causing the writing transistor to enter a non-conduction state is set to be lower than ($V_{th_WS}+V_{th_Drv}+V_{ss}$), and the driving unit applies the fixed potential to the source electrode of the driving transistor via the switching transistor before writing the reference voltage that is used when a threshold voltage is corrected to the gate electrode of the driving transistor.

[11] A method of driving a display device in which pixels are arranged, each pixel including a light emitting unit, a writing transistor that writes a video signal, a driving transistor that drives the light emitting unit based on the video signal written by the writing transistor, and a switching transistor that applies a fixed potential to one terminal of the light emitting unit, wherein a voltage causing the driving transistor to enter a non-conduction state is written to a gate electrode of the driving transistor to cause the light emitting unit to enter a light extinction state in driving the display device.

[12] An electronic apparatus with a display device including: a pixel array unit in which pixels are arranged, each pixel including a light emitting unit, a writing transistor that writes a video signal, a driving transistor that drives the light emitting unit based on the video signal written by the writing transistor, and a switching transistor that applies a fixed potential to one terminal of the light emitting unit; and a driving unit that causes the light emitting unit to enter a light extinction state by writing a voltage causing the driving transistor to enter a non-conduction state to a gate electrode of the driving transistor.

It should be understood by those skilled in the art that various modifications, combinations, sub-combinations and alterations may occur depending on design requirements and other factors insofar as they are within the scope of the appended claims or the equivalents thereof.

What is claimed is:

1. A display device comprising:

a pixel array unit in which pixels are arranged, each pixel including a light emitting unit, a writing transistor that writes a video signal, a driving transistor that drives the light emitting unit based on the video signal written by the writing transistor, and a switching transistor that applies a fixed potential to one terminal of the light emitting unit; and a driving unit that causes the light emitting unit to enter a light extinction state by writing a voltage causing the driving transistor to enter a non-conduction state to a gate electrode of the driving transistor, wherein the driving unit applies a fixed potential to a source electrode of the driving transistor via the switching transistor in a state in which the voltage causing the driving transistor to enter the non-conduction state is written to the gate electrode of the driving transistor.

2. The display device according to claim 1, wherein each pixel of the pixel array unit has a function of correcting a threshold voltage of the driving transistor.

3. The display device according to claim 2, wherein the voltage causing the driving transistor to enter the non-conduction state is a reference voltage that is used when the threshold voltage is corrected.

4. The display device according to claim 2, wherein the driving unit writes the voltage causing the driving transistor to enter the non-conduction state to a holding capacitor.

5. The display device according to claim 2, wherein, when a threshold voltage of the writing transistor is $V_{th_WS}$, the threshold voltage of the driving transistor is $V_{th_Drv}$, and the fixed potential applied to a source electrode of the driving transistor is $V_{ss}$, a voltage causing the writing transistor to enter a non-conduction state is set to be lower than ($V_{th_WS}+V_{th_Drv}+V_{ss}$) and the driving unit applies the fixed potential to the source electrode of the driving transistor via the switching transistor before writing a reference voltage that is used when the threshold voltage of the driving transistor is corrected to the gate electrode of the driving transistor.

6. The display device according to claim 1, wherein the driving unit writes a voltage lower than the voltage causing the driving transistor to enter the non-conduction state to the gate electrode of the driving transistor when the switching transistor is in a conduction state.

7. The display device according to claim 6, wherein, when a threshold voltage of the driving transistor is $V_{th_Drv}$ and the fixed potential applied to the source electrode of the driving transistor is $V_{ss}$, the voltage that is written to the gate electrode of the driving transistor in the conduction state of the switching transistor is lower than ($V_{th_Drv}+V_{ss}$).

8. The display device according to claim 7, wherein the voltage that is written to the gate electrode of the driving transistor in the conduction state of the switching transistor is lower than a reference voltage that is used when the threshold voltage of the driving transistor is corrected.

9. The display device according to claim 8, wherein the driving unit writes the reference voltage that is used when the threshold voltage of the driving transistor is corrected and a voltage lower than the reference voltage to the gate electrode of the driving transistor via the writing transistor.

10. A method of driving a display device in which pixels are arranged, each pixel including a light emitting unit, a writing transistor that writes a video signal, a driving transistor that drives the light emitting unit based on the video signal written by the writing transistor, and a switching transistor that applies a fixed potential to one terminal of the light emitting unit, the method comprising:

writing a voltage causing the driving transistor to enter a non-conduction state to a gate electrode of the driving transistor to cause the light emitting unit to enter a light extinction state in driving the display device; and applying the fixed potential to the source electrode of the driving transistor via the switching transistor in a state in which the voltage causing the driving transistor to enter the non-conduction state is written to the gate electrode of the driving transistor.

11. An electronic apparatus with a display device, the display device comprising:

a pixel array unit in which pixels are arranged, each pixel including a light emitting unit, a writing transistor that writes a video signal, a driving transistor that drives the light emitting unit based on the video signal written by the writing transistor, and a switching transistor that applies a fixed potential to one terminal of the light emitting unit; and a driving unit that causes the light emitting unit to enter a light extinction state by writing a voltage causing the driving transistor to enter a non-conduction state to a gate electrode of the driving transistor, wherein the driving unit applies a fixed potential to a source electrode of the driving transistor via the switching transistor in a state in which the voltage causing the driving transistor to enter the non-conduction state is written to the gate electrode of the driving transistor.

* * * * *